US008538313B2

(12) United States Patent
Tanaka

(10) Patent No.: US 8,538,313 B2
(45) Date of Patent: Sep. 17, 2013

(54) IMAGE FORMING APPARATUS

(75) Inventor: Akinori Tanaka, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 541 days.

(21) Appl. No.: 12/638,738

(22) Filed: Dec. 15, 2009

(65) Prior Publication Data

US 2010/0150633 A1 Jun. 17, 2010

(30) Foreign Application Priority Data

Dec. 17, 2008 (JP) ..... 2008-321640

(51) Int. Cl.
*G03G 15/00* (2006.01)
*B65H 9/00* (2006.01)

(52) U.S. Cl.
USPC ..... 399/395; 399/401; 271/245

(58) Field of Classification Search
CPC ..... G05G 15/00
USPC ..... 399/401, 395; 221/226, 244; 271/226, 271/244, 245
See application file for complete search history.

(56) References Cited

U.S. PATENT DOCUMENTS 5,055,885 A * 10/1991 Yoshikado et al. ..... 399/401
6,032,949 A 3/2000 Ando
6,873,820 B2 3/2005 Tanaka et al.
7,386,270 B2 * 6/2008 Moteki ..... 399/406
2002/0149805 A1 10/2002 Tanaka et al.
2006/0280536 A1 * 12/2006 Isohara et al. ..... 399/401
2009/0189338 A1 * 7/2009 Yu et al. ..... 271/229

FOREIGN PATENT DOCUMENTS

JP 01087466 A * 3/1989
JP 04327447 A * 11/1992
JP 9100056 A 4/1997
JP 2002234639 A * 8/2002
JP 2002-292960 A 10/2002
JP 2008-120579 A 5/2008
JP 2008-239306 A 10/2008

* cited by examiner

*Primary Examiner* — Ren Yan
*Assistant Examiner* — Nguyen Q Ha
(74) *Attorney, Agent, or Firm* — Canon USA Inc IP Division

(57) ABSTRACT

The present invention includes an image forming unit, a reversing unit configured to reverse the sheet on which the image has been formed by the image forming unit, a reconveyance path which conveys the sheet reversed by the reversing unit to a feeding path for forming an image on the sheet by the image forming unit again, a position detection unit which is provided on the reconveyance path and configured to detect a position of the sheet in a width direction, a skew-feeding correction unit which is provided on the reconveyance path and configured to correct skew-feeding of the sheet, wherein the position detection unit is disposed on the downstream of the skew-feeding correction unit in reconveyance path, wherein the image forming unit corrects the position of the image to be formed on the sheet, which is conveyed through the reconveyance path, based on a signal from the positioning detection unit.

13 Claims, 13 Drawing Sheets

IMAGE FORMING APPARATUS

BACKGROUND OF THE INVENTION

1. Field of the Invention

The present invention relates to an image forming apparatus which forms an image on a sheet, particularly to a copying machine, a printer and a facsimile machine.

2. Description of the Related Art

When an image is formed on both sides of a sheet in an image forming apparatus such as a copying machine, a printer and a facsimile machine, the image is initially formed on one surface (first surface) of the sheet and then the sheet is reversed such that a leading edge and a trailing edge of the sheet are countercharged to each other to be conveyed again. After a reversing conveyance of the sheet is carried out, the sheet passes through a two-sided conveyance path and an image is formed on another surface (second surface) of the sheet.

Japanese Patent Laid-open Publication No. 2002-292960 discusses such a configuration that, when the image is formed on the second surface of the sheet, a writing position in a main scanning direction (in a width direction intersecting with a conveying direction) of the image is corrected in the main scanning direction based on information from a position detection unit which is positioned in the two-sided conveyance path to detect a position of the sheet. Accordingly, positions of the images on the first surface and the second surface of the sheet are registered to each other.

In an electro-photographic color image forming apparatus, more specifically, in an apparatus in which toner images of respective colors are primary-transferred from a photosensitive drum to an intermediate transfer belt and the toner images of the respective colors which overlap one another in the secondary transfer unit are collectively transferred on the sheet, the position detection unit is provided in the two-sided conveyance path. This is because a distance between a first transfer unit and the second transfer unit is long in the color image forming apparatus and thus a position of the sheet is to be detected in an upstream side in the sheet conveying direction as far as possible when the toner images are transferred from the photosensitive drum to the intermediate transfer belt after the position detection unit detects the position of the sheet.

Further, Japanese Patent Laid-open Publication No. 09-100056 discusses an apparatus which using a reversing roller, performs the reverse-conveyance of the sheet for the purpose of correcting skew of the sheet having an image formed on the first surface. The skew of the sheet is corrected by bringing a leading edge of the sheet into contact with the reversing roller which stops rotation before the operation. Subsequently, the sheet is reversed by the reversing roller after the skew of the sheet is corrected and is conveyed to an image forming unit again in order to form another image on the second surface of the sheet.

In the two-sided conveyance path, when the position of the sheet in the width direction is detected by the position detection unit, it is material that the sheet is not skewed. It is because, if the sheet is skewed when the skew is corrected before forming the image, an error may arise in an accuracy of detection of the position of the sheet in the width direction by an amount of the skew. For example, if the another image is formed on the second surface based on sheet position information which is acquired from the detection unit and contains the error, misregistration occurs between an image position of the first surface and an image position of the second surface.

A certain effect can be produced to resolve the above described problem which arises when the position of the sheet in the width direction is detected by the position detection unit, if a technique is applied which brings the leading edge of the sheet into contact with the reversing roller in a rest position to correct skew of the sheet. However, when the sheet is reversed, rollers other than the reversing roller do not contact the sheet and thus the sheet is conveyed in a forward and backward direction only by using the reversing roller. Therefore, when the sheet is reversed by the reversing roller, the skew-feeding of sheet tends to occur. Since the position detection unit detects the position of the sheet in the width direction while the skew-feeding occurs when the sheet is reversed by the reversing roller, the accuracy in detecting the position of the sheet is reduced.

SUMMARY OF THE INVENTION

The present invention is directed to providing an image forming apparatus which can reduce an adverse effect of skew-feeding of a sheet when the sheet is reversed in forming an image on the sheet.

According to an aspect of the present invention, an image forming apparatus includes a sheet feeder configured to feed a sheet contained in the sheet container, a feeding path in which the sheet, fed by the sheet feeder, is conveyed, an image forming unit configured to form an image on the sheet conveyed in the feeding path, a reversing unit configured to reverse the sheet on which the image has been formed by the image forming unit, a reconveyance path which conveys the sheet reversed by the reversing unit to the feeding path for forming an image on the sheet by the image forming unit again, a position detection unit which is provided on the reconveyance path and configured to detect a position of the sheet in a width direction which intersects with a sheet conveying direction of the sheet conveyed in the reconveyance path, a skew-feeding correction unit which is provided on the reconveyance path and configured to correct skew-feeding of the sheet, wherein the position detection unit is disposed on the downstream of the skew-feeding correction unit in reconveyance path, and wherein the image forming unit corrects the position of the image to be formed on the sheet, which is conveyed through the reconveyance path, based on a signal from the positioning detection unit.

According to the present invention, the image forming apparatus which can form the image on the sheet while reducing the adverse effect of the skew-feeding of the sheet when the sheet is reversed.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

DESCRIPTION OF THE EMBODIMENTS

Various exemplary embodiments, features, and aspects of the invention will be described in detail below with reference to the drawings.

Figure 1:
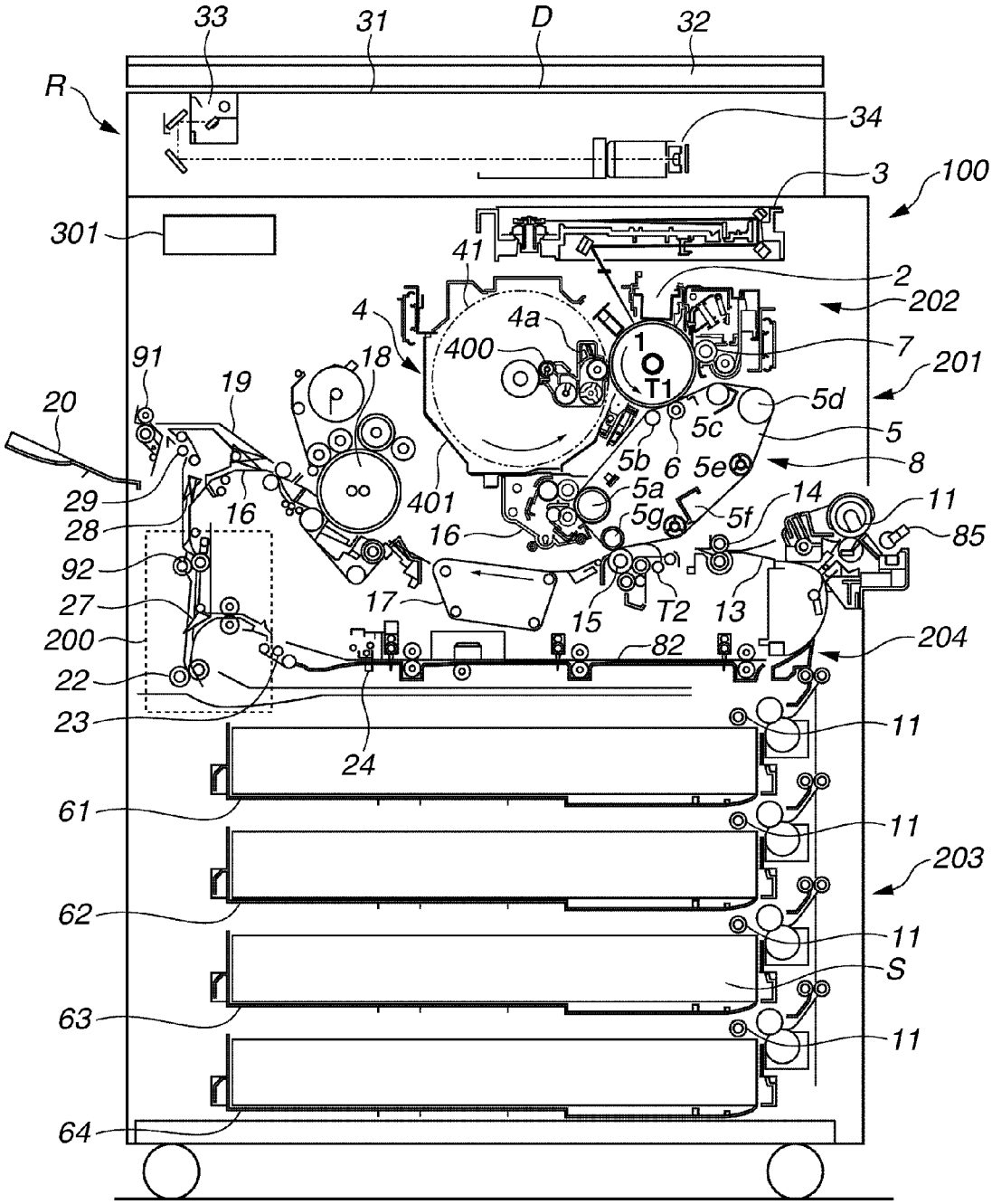
FIG. 1 is a cross sectional view of an image forming apparatus according to a first exemplary embodiment of the present invention.

FIG. 1 schematically illustrates a configuration of an exemplary color copying machine of an image forming apparatus according to a first exemplary embodiment of the present invention.

In FIG. 1, the image forming apparatus includes a color copying machine 100 and a color copying machine body (hereinafter referred to as the "apparatus body"). The apparatus body 201 is provided with an image forming unit 202, a paper feed unit 203 configured to feed a sheet S and a sheet conveying apparatus 204 configured to convey the sheet S, which is fed from the paper feed unit 203, within the apparatus body 201. An upper section of the apparatus body 201 is provided with a reader unit R.

The reader unit R includes a document positioning glass plate 31 and a document pressing sheet 32 which can open and close the document positioning glass plate 31. A colored document O is placed on the document positioning glass plate 31 in accordance with a predetermined position reference with an image surface downward-facing, and the document pressing sheet 32 is placed to cover the colored document O, thereby setting the colored document O on the document positioning glass plate 31.

The image forming apparatus may be configured such that the document pressing sheet 32 is substituted by an automatic document feeder (ADF) to automatically feed sheet-like documents onto the document positioning glass plate 31.

A moving optical system 33 is driven to move along an under surface of the document positioning glass plate 31. The moving optical system 33 optically scans the image surface of the document O which is placed on the document positioning glass plate 31 with the image surface downward-facing. Document scanning light forms an image on a charge coupled device (CCD) 34 which is a photoelectric conversion element (solid-state image sensor). The scanning light is divided into three primary colors such as red, green and blue (RGB) to be read out. Thus read out signal of each of the RGB colors (not shown) is input into the image processing unit.

The image forming unit 202 includes an electrophotographic photosensitive drum 1 (hereinafter referred to as the "photosensitive drum") as an image carrier which rotates in a counterclockwise direction by means of a motor (not shown). Further, the image forming unit 202 is provided with an electric charger 2 and a laser scanner 3. Still further, the image forming unit 202 is provided with a cleaning device 7 configured to clean up residual toner on the photosensitive drum, a developing unit 4 and the others.

The photosensitive drum 1 is rotated in the counterclockwise direction at a predetermined rate. A surface of the photosensitive drum 1 is uniformly charged to have a predetermined polarity/potential by the electric charger 2 as a charging means. The laser scanner 3 includes a laser output unit, a polygonal mirror, an imaging lens, a mirror forming a reflected optical path and outputs laser light (light signal) which is modulated according to an image information signal input from an image processing unit (not shown). Thus, a surface of the rotating photosensitive drum 1 to be charged is scan-exposed.

The scan exposure performed by the laser scanner 3, in a manner as described above, forms an electrostatic latent image on the surface of the photosensitive drum 1. The image information signal may be synthesized or formed based on image information which is electrically sent from an external device such as a personal computer, in addition to the image information read out from the above described reader unit R.

A developing unit 4 includes a rotary 41 configured to be rotated in the counterclockwise direction as illustrated by an arrow A and developing devices of 4 colors such as a developing device for a back color, and not-shown developing devices for a yellow color, a magenta color and a cyan color. The developing devices are provided on the rotary 41 for the sake of a color development.

Further, in the developing unit 4, the rotary 41 is rotated at a predetermined angle and in an arrow direction at a predetermined controlled timing, so that each of the developing devices is switched to a development position opposing to the photosensitive drum 1. At the development position, a distance (SD distance) between the photosensitive drum 1 and a developing sleeve at a side of the developing device is kept within a predetermined range and a toner image is sequentially formed on the photosensitive drum by developing the electrostatic latent image for every color with the corresponding developing device.

An intermediate transfer belt unit 8 includes an endless intermediate transfer belt 5 which is configured to transfer a color image onto the sheet S after 4 color toner images overlap one another to be transferred to create the color image. Further, the intermediate transfer belt unit 8 includes a primary transfer roller 6 configured to transfer each of the toner images of different colors, which was formed on the photosensitive drum 1, onto the intermediate transfer belt 5.

The intermediate transfer belt 5 is an endless belt made of a dielectric material. The transfer belt 5 has flexibility and is stretched around a plurality of rollers 5*a* through 5*g*. The intermediate transfer belt 5 is rotated in the clockwise direction at a rate almost equal to a rotational rate of the photosensitive drum 1 by using, for example, the roller 5*a* as a driving roller.

An outer surface of the intermediate transfer belt 5 contacts the photosensitive drum 1 in a range between rollers 5*b* and 5*c*. The contact portion is referred to as a primary transfer nip portion T1. At the primary transfer nip portion T1, the primary transfer roller 6 is disposed opposite to the photosensitive drum 1 and contacts an inner surface of the intermediate transfer belt 5.

A primary transfer voltage having a polarity opposite to a toner is applied to the primary transfer roller 6 at a predetermined control timing, and the application of the primary transfer voltage causes each of the toner images of different colors, which was formed on the photosensitive drum 1, to be transferred to the intermediate transfer belt 5. Residual toner on the intermediate transfer belt 5 is scraped off from the intermediate transfer belt 5 by a belt cleaning unit 16 serving as a cleaning unit which is provided across the intermediate transfer belt 5 to clean the intermediate transfer belt 5.

A secondary transfer outer roller 15 transfers the toner image from the intermediate transfer belt 5 to the sheet S. Further, the secondary transfer outer roller 15 is provided to contact with and separate from the intermediate transfer belt 5 by a pressure-control mechanism (not shown).

The secondary transfer outer roller 15 moves to a first position where the secondary transfer outer roller 15 contacts and presses the intermediate transfer belt 5 against a roller 5*g* among the rollers 5*a* through 5*g*, around which the intermediate transfer belt 5 is stretched, when each toner image is transferred to the sheet S. The movement of the secondary transfer outer roller 15 to the first position forms a secondary transfer nip portion T2 between the secondary transfer outer roller 15 and an outer surface of the intermediate transfer belt 5. Further, the secondary transfer outer roller 15 moves to a second position which is away from the outer surface of the intermediate transfer belt 5 when the toner image is not transferred to the sheet S, i.e., in a standby state. In a downstream side of the secondary transfer nip portion T2, a fixing unit 18 configured to fix the unfixed image on the sheet is provided.

The paper feed unit 203 includes sheet cassettes (sheet container) 61 through 64 configured to contain sheets S and to be detachable from the apparatus body 201. The sheets S stored within the sheet cassettes 61 through 64 are sent out by pick up rollers 11 as a sheet feeder, respectively. Further, the paper feed unit 203 includes a manual feed tray 85 for multiple sizes of sheets. The sheets placed within the manual feed tray 85 for multiple sizes of sheets are sent out by the pick up roller 11 or the like.

Further, the sheet conveying apparatus 204 includes a registration roller pair 14, a carrying belt unit 17 and a sheet reversing unit 200. The carrying belt unit 17 conveys a sheet, on which a toner image is transferred, to a fixing unit 18 in a manner as described below. The sheet reversing unit 200 reverses and conveys the sheet after the image is formed on the sheet. The registration roller pair 14 improves the precision of a position of the oriented sheet S, and sends the sheet S at right timing in synchronization with the toner image on the intermediate transfer belt. The registration roller pair 14 is provided in the upstream side of the secondary transfer nip portion T2.

The sheet reversing unit 200, which is described below in detail, is provided in a lower section lateral to the apparatus body 201. The sheet reversing unit 200 once draws the sheet, on which image has been fixed by the fixing unit 18, into itself, reverses a conveying direction of the sheet, and thereafter sends the sheet out.

A control unit 301 controls operations of the image forming unit 202, the paper feed unit 203, the sheet conveying apparatus 204 and the reader unit R, respectively.

Now, an image forming operation of the color copying machine 100 having the above described configuration is described below.

When the document O is placed on a document positioning glass plate 31 such that the image surface faces downward and is pressed against the document positioning glass plate 31 by the document pressing sheet 32 from above. The moving optical system 33 moves while irradiating the document with light to scan the image surface of the document. Then, the document scanning light is focused on the CCD 34, and is divided and read out according to the three primary colors of the RGB (red, green and blue).

Then, the read out signals of the RGB, respectively, are input into an image processing unit (not shown) to be subjected to various image processing in the image processing unit. Thereafter, the signal is output to a laser scanner 3 in the form of an image information signal.

The laser scanner 3 modulates the image information signal into a light signal. The photosensitive drum is irradiated with thus modulated light signal as a first color light signal through a lens and reflection mirrors. At the time, the photosensitive drum 1 is uniformly preliminary-charged to a predetermined polarity/potential by the electric charger 2. An electrostatic latent image is formed by irradiating the photosensitive drum 1 with the light signal.

The electrostatic latent image is developed by a developing device corresponding to the first color, which was selected from a plurality of developing devices provided in the developing unit 4, and a first color toner image is formed. Subsequently, the toner image formed on the photosensitive drum is transferred onto the intermediate transfer belt 5 by the primary transfer roller 6 at the first transfer nip portion T1.

If the image forming apparatus is in a color mode, the intermediate transfer belt 5, on which the toner image has been transferred, is further rotated to form and transfer the next toner image onto the intermediate transfer belt 5. While the intermediate transfer belt 5 is rotating, the developing unit 4 causes the developing device of the next designated color to rotate by 90 degrees in an arrow B direction to cause the developing device to face to the photosensitive drum 1 and gets ready for a development of the next electrostatic latent image.

After the primary transfer of the first color toner image, a second color toner image, a third color toner image and a fourth color toner image sequentially overlap onto the intermediate transfer belt 5 by repeating formation of a latent image, development and primary transfer in the same manner as is performed for the first color toner image. Residual toner, which was not transferred onto the intermediate transfer belt 5 but remained on the surface of the photosensitive drum 1 after the primary transfer, is removed from the surface of the photosensitive drum 1 by a cleaning device 7. The photosensitive drum 1 is repeatedly used in an image formation after the surface of the photosensitive drum 1 is cleaned by the cleaning device 7 in a manner as described above.

On the other hand, a pickup roller 11 of, for example, the sheet cassette 61, which was preliminary selected from the sheet cassette 61 through 64 or the manual feed tray 85 for multiple sizes of sheets, is driven at a predetermined control timing in parallel with the above described image forming operation. Accordingly, a single sheet S stored in the sheet cassette 61 is separated and sent out from the sheet cassette 61 to the registration roller pair 14 through a sheet feeding path 13.

At the time, the registration roller pair 14 is in rest position and the skew-feeding of the sheet S is corrected by bringing the sheet S into contact with the registration roller pair 14 in rest position. Then, the sheet S is sent at right timing by the registration roller pair 14 to the secondary transfer nip portion T2, which is formed of the intermediate transfer belt 5 and the secondary transfer outer roller 15. At the time, the secondary transfer outer roller 15 has moved to the first position at the predetermined control timing.

Then, the sheet S is nipped and conveyed through the secondary transfer nip portion T2. While the sheet S is nipped and conveyed through the secondary transfer nip portion T2, a predetermined secondary transfer voltage is applied to the secondary transfer outer roller 15, so that the toner images on the intermediate transfer belt 5 made of a plurality of color toners is collectively transferred onto the sheet S in an electrostatic way. As a result, an unfixed toner image is formed (transferred) on the sheet S.

The residual toner, which was not transferred onto the sheet S but remained on the surface of the intermediate transfer belt 5 after the secondary transfer, is removed from the surface of the intermediate transfer belt 5 by the cleaning unit 16. The intermediate transfer belt 5, which was cleaned by the belt cleaning unit 16, is repeatedly used in the image forming processing.

The sheet S, which is sent to the secondary transfer nip portion T2 and to which the toner image is transferred by the secondary transfer outer roller 15, is separated from the surface of the intermediate transfer belt 5 and conveyed to the fixing unit 18 by a carrying belt unit 17. Then, the sheet S is heated and pressed by the fixing unit 18. As a result, the unfixed toner image is fusion-bonded on the sheet S to form a fixed image.

The sheet S on which the toner image is fixed is conveyed to a sheet delivery roller pair 91 through a sheet path 19 to be discharged onto a discharge tray 20.

If, for example, a double-sided print mode is selected, the sheet which comes out from the fixing unit 18 is guided by a switch member 26 to a vertically extending vertical path and led to the sheet reversing unit 200 by a vertical conveyance roller pair 92. Thereafter, the sheet is reversed by the sheet reversing unit 200. Accordingly, the sheet is conveyed toward the two-sided conveyance path 82 while a trailing edge of the sheet serves as the leading edge. At the time, the sheet S is sent into the two-sided conveyance path 82 while the sheet S corrects its curled state with a decurl belt 23. The sheet reversing unit 200 is described below in detail.

The two-sided conveyance path 82 is provided with a lateral registration detection sensor 24 as a position detection unit. A position of the sheet in a main scanning direction (in a width direction of the sheet) is detected by the lateral registration detection sensor 24. The lateral registration detection sensor 24 of the present exemplary embodiment includes a sensor which is movable in the width direction of the sheet and detects a position of a lateral edge of the sheet along a sheet conveying direction while the lateral registration detection sensor 24 moves in the width direction. The lateral registration detection sensor 24 may be configured such that the position of the sheet in the width direction is detected by detecting the position of the lateral edge of the sheet along the sheet conveying direction by using a contact image sensor (CIS) which extends in the width direction of the sheet.

The sheet, which is sent to the image forming unit again through the two-sided conveyance path 82 serving as a reconveyance path, is provided with an image on the second surface of the sheet. Position information of the lateral edge of the sheet, which was detected by the lateral registration detection sensor 24, is used for a correction of a writing position of the image on the rear surface (second surface) of the sheet in the main scanning direction. In other words, the control unit 301 adjusts the position of the image, which is formed on the second surface of the sheet, to register the image at a proper position based on a position of the lateral edge of the sheet which was detected by the lateral registration detection sensor 24.

Therefore, even if there is a fluctuation of the position of the sheet in the main scanning direction in the upstream side of the lateral registration detection sensor 24, the image can be formed on the rear surface of the sheet at the same position in the main scanning direction which corresponds to the image on the first surface. The correction of the writing position of the image in the main scanning direction is performed at the time that the laser scanner 3 forms a latent image on the photosensitive drum 1. Since how to correct the writing position is publicly known, a detailed description thereof is omitted here.

After the image is formed on the second surface of the sheet, the sheet S passes through the fixing unit 18 again to be discharged onto the discharge tray 20 by the sheet delivery roller pair 91 through a sheet path 19.

When the sheet is reversed and inversely discharged, the sheet is guided to the sheet reversing unit 200 by the switch member 26. Then, the sheet is reversed by the sheet reversing unit 200, subjected to decurl correction processing by the decurler 29, and discharged onto the discharge tray 20. The decurler 29 forms a downward curl in the sheet and discharges thus curled sheet to the discharge tray. The downward curl is formed in the sheet to be discharged in order to keep the sheets stacked on the tray in a good condition.

Figure 2:
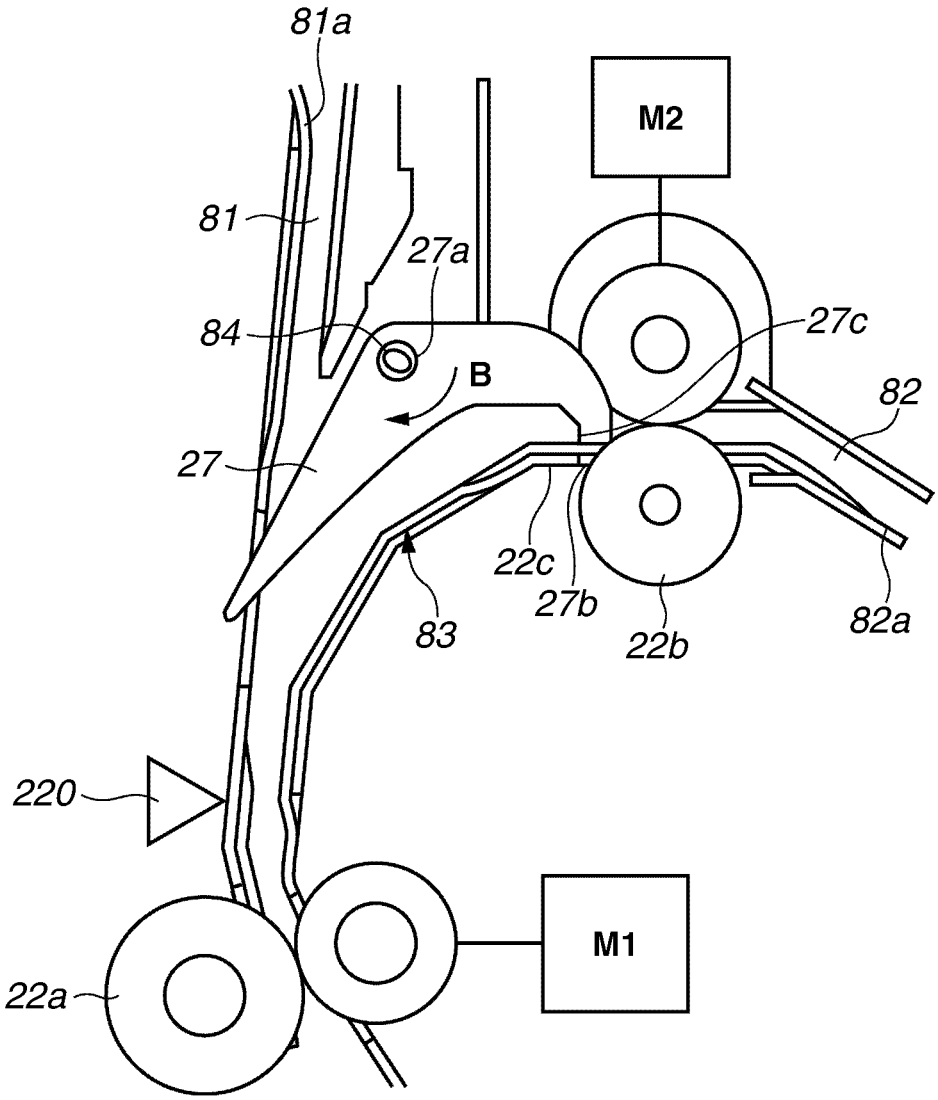
FIG. 2 is an enlarged view of a sheet reversing unit.

Now, a configuration of the sheet reversing unit 200 is described in detail. FIG. 2 illustrates a detailed configuration of the sheet reversing unit 200.

The sheet reversing unit 200 conveys the sheet, which is sent through a sheet conveyance path 81 extending substantially in a vertical direction to convey sheets, to the two-sided conveyance path 82 serving as the reconveyance path which causes the sheet to diverge in the diverging unit 83 from the sheet conveyance path 81. The sheet conveyance path 81 includes a sheet conveyance guide 81*a*. The two-sided conveyance path 82 includes a two-sided conveyance guide 82*a*. The two-sided conveyance path 82 joins into the sheet feeding path 13 at the downstream end of the two-sided conveyance path 82 in the conveying direction.

The diverging unit 83 of the sheet reversing unit 200 is provided with a guiding member 27 swingably attached to the diverging unit 83. The guiding member 27 is biased in a clockwise direction in FIG. 2 by a torsion coil spring 84 as a biasing unit. The guiding member 27 is normally biased by the torsion coil spring 84, so that an end portion 27*b* of the guiding member rests in a standby position at which the sheet contacts a contact portion 22*c* as a portion of the two-sided conveyance guide 82*a*.

A lower section of the diverging unit 83 is provided with a reversing roller pair 22*a* as a reversing unit of the present invention, which can reverse the sheet conveyance direction and is rotatable in both a forward and backward direction. In the two-sided conveyance path 82 adjacent to the diverging unit 83, the conveyance roller pair 22*b* is provided. The reversing roller pair 22*a* is rotated by receiving a driving force from a reversing motor M1. The conveyance roller pair 22*b* is rotated by receiving a driving force from a conveying motor M2.

The sheet reversing unit 200 is further provided with a reverse sensor 220 as a sheet detection device which detects a sheet between the diverging unit 83 and the reversing roller pair 22*a*.

Hereinafter, operations when reversing the sheet is described with reference to FIGS. 4 through 8 and an operation flow chart of FIG. 3.

Figure 3:
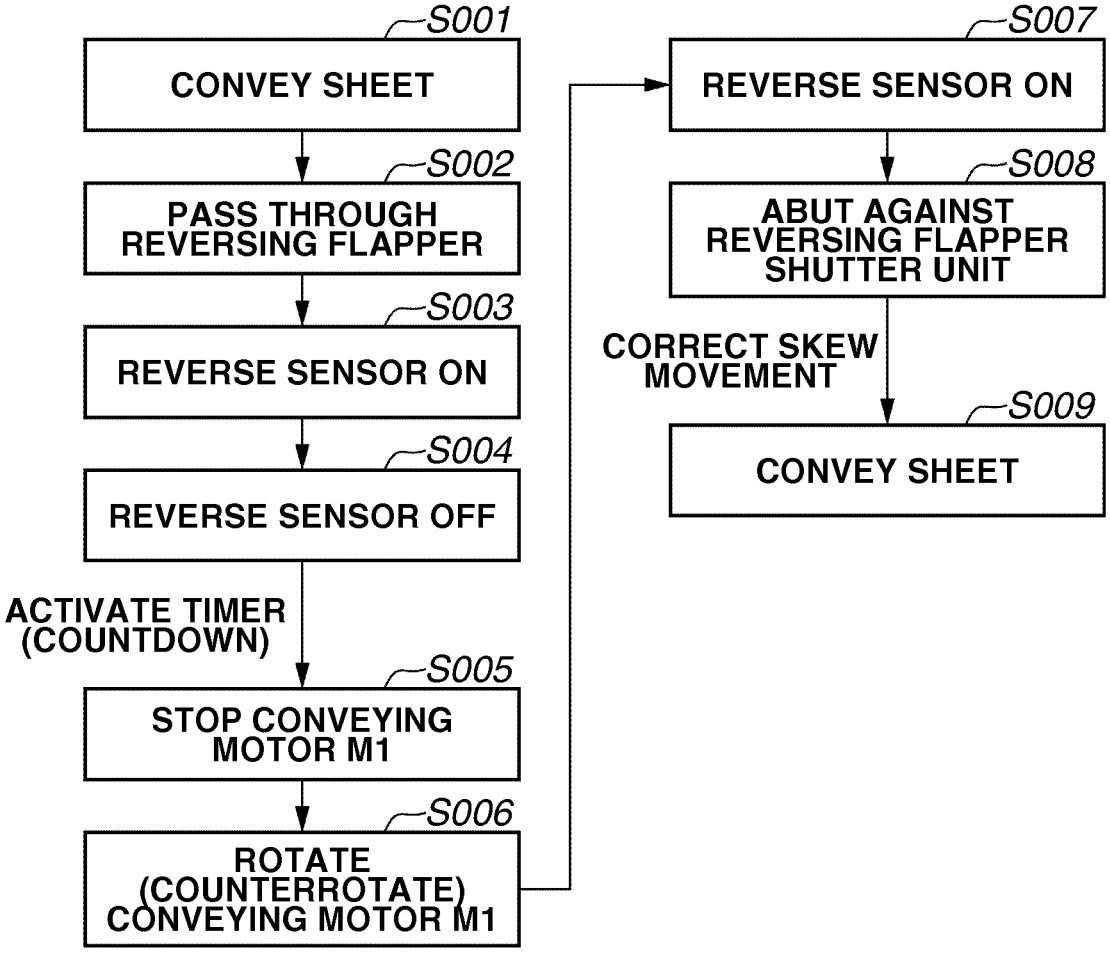
FIG. 3 is a flow chart illustrating how to reverse a sheet.
Figure 4:
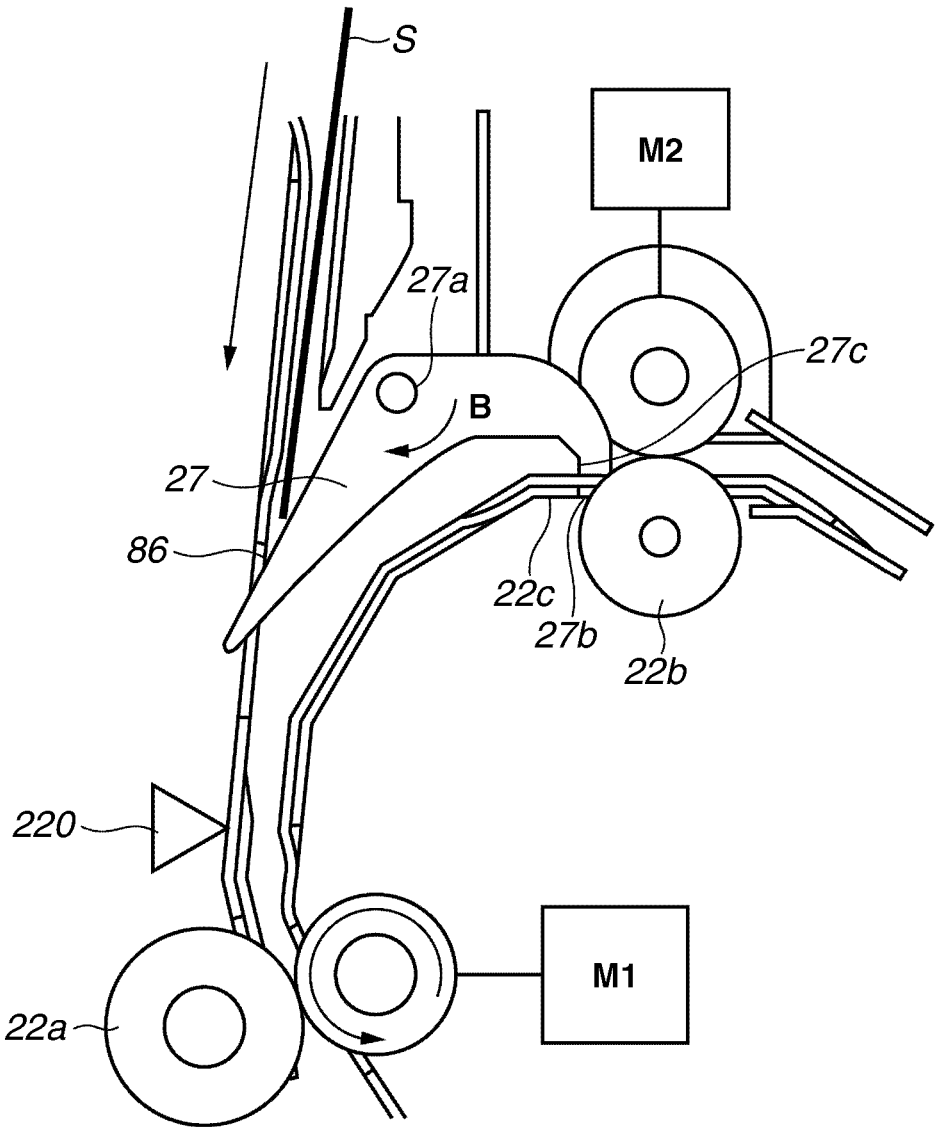
FIG. 4 illustrates a state that the sheet comes into the sheet reversing unit.

In step S001 of FIG. 3, the sheet with an image on the first surface, is conveyed from the upstream side through a sheet conveyance path 81*a* by a vertical conveyance roller pair (see FIG. 1) as an upstream side conveyance unit as illustrated in FIG. 4. At the time, as described above, the guiding member 27 rests in the standby position at which the end portion 27*b* of the guiding member contacts the contact portion 22*c*, which is a portion of the two-sided conveyance guide 82*a*, by a biasing force of the torsion coil spring 84.

Figure 5:
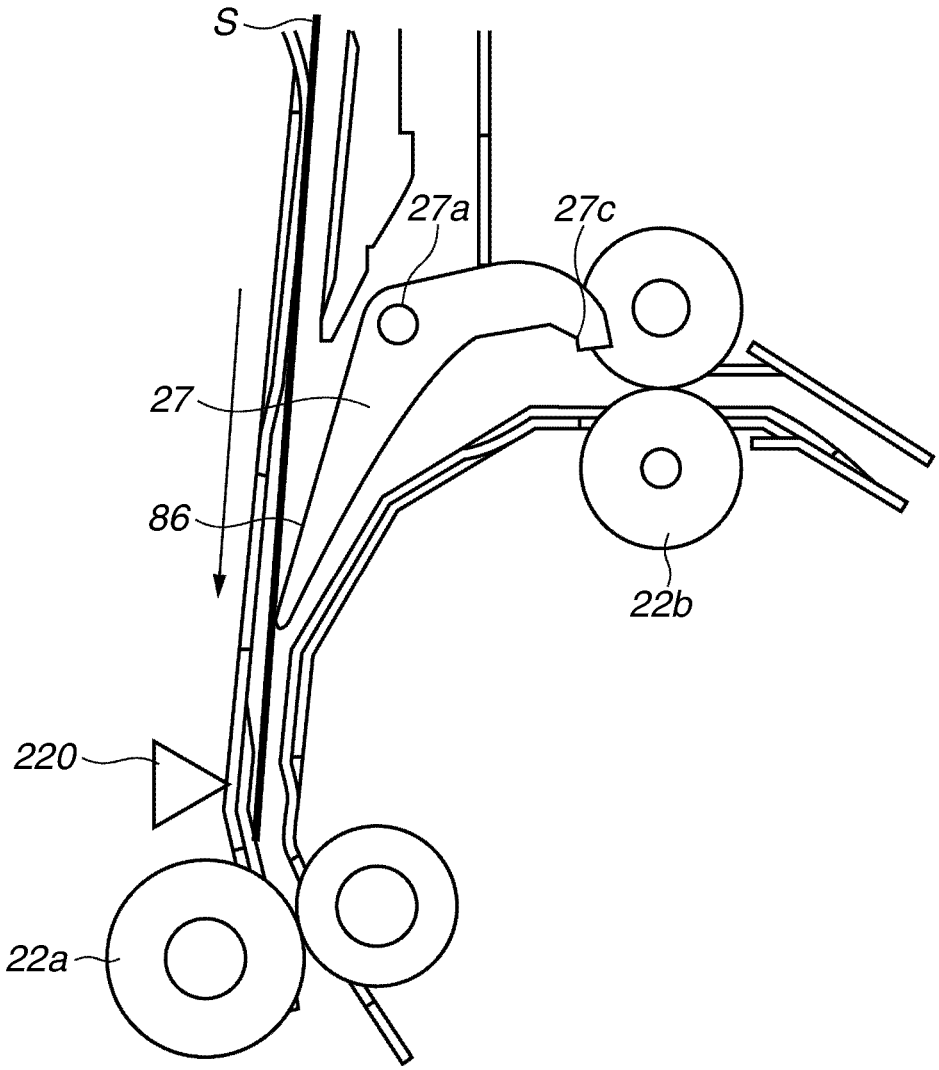
FIG. 5 illustrates a state that a guiding member is rotated in order to convey the sheet.

When the sheet is further conveyed downward, the sheet comes to contact with a first side surface 86 of the guiding member 27 as illustrated in FIG. 5. In step S002 of FIG. 3, the sheet is conveyed downward while the sheet is swinging the guiding member 27 against the biasing force of the torsion coil spring 84 which biases the guiding member 27.

In step S003 of FIG. 3, when the sheet reaches the reverse sensor 220, the reverse sensor 220 generates an ON signal. Subsequently, the sheet is received by the reversing roller pair 22*a* to be further conveyed downward, i.e., in a first direction, by the reversing roller pair 22*a*.

While the sheet is conveyed downward by the reversing roller pair 22*a*, the trailing edge (i.e., upstream end) of the sheet passes through the reverse sensor 220. In step S004 of FIG. 3, when the trailing edge of the sheet passes through the reverse sensor 220, the reverse sensor 220 sends an OFF signal to the control unit 301.

Figure 6:
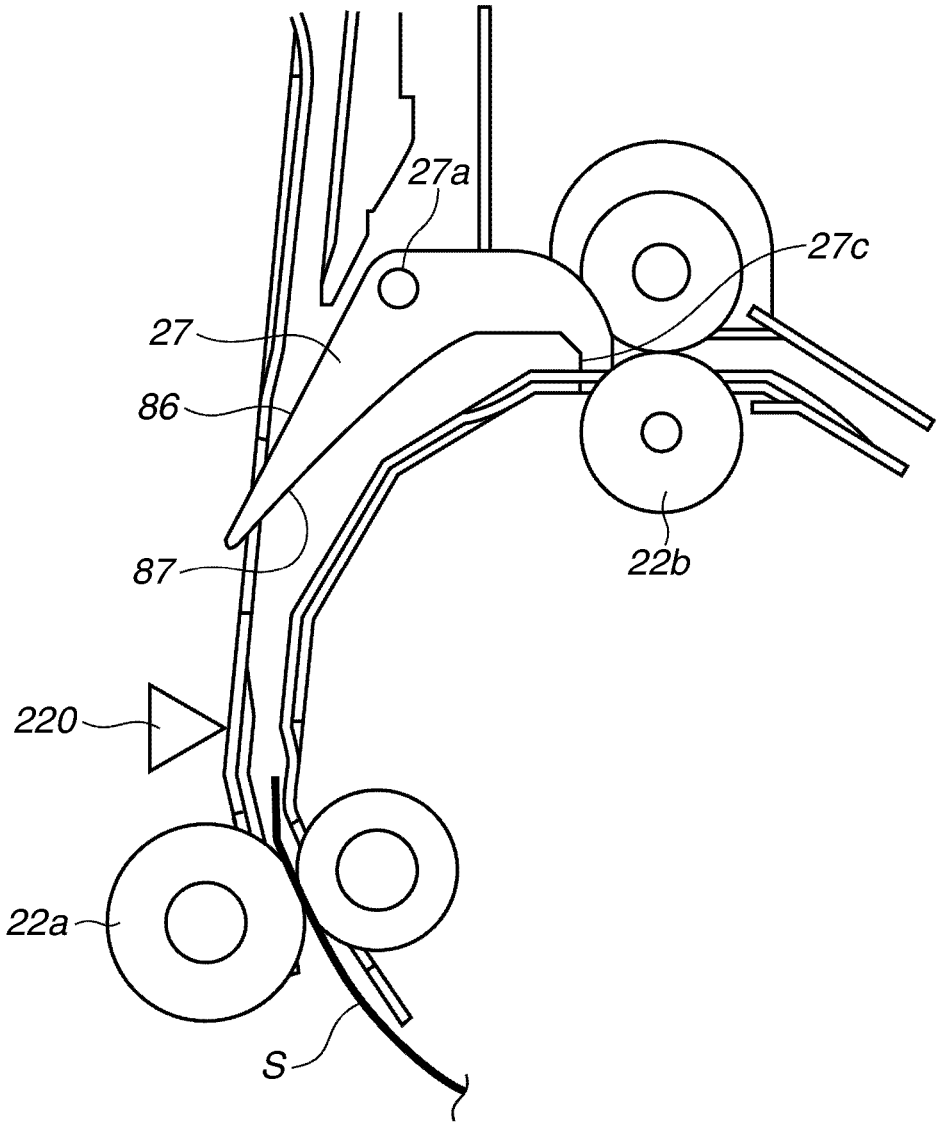
FIG. 6 illustrates the sheet in rest position at a reversing point.

In steps S005 and S006 of FIG. 3, the control unit 301 controls the reversing motor M1 such that the reverse sensor 220 stops the reversing roller pair 22*a* and causes the reversing roller pair 22*a* to rotate in a reverse direction when a predetermined time period elapses after the reverse sensor 220 sends the OFF signal to the control unit 301. FIG. 6 illustrates a state that the reversing roller pair 22*a* is once paused. A position of the sheet, when the reversing roller pair 22*a* is stopped in the reversing processing of the sheet, is referred to as the reversing point.

After the trailing edge of the sheet passes through the guiding member 27, the guiding member 27, which was pushed by the sheet, returns to the original standby position due to the biasing force of the torsion coil spring 84 (see FIG. 6). The guiding member 27 recovers to the standby position before the sheet is subjected to a reverse processing.

The sheet is conveyed upward, i.e., in a second direction which is opposite to the present conveying direction, by the reversing roller pair 22*a* owing to the reverse rotation of the reversing motor M1. The sheet conveyed upward is guided and conveyed in a conveying direction c in FIG. 7 by a second side surface 87 of the guiding member 27 in a rest position. In other words, the sheet is guided by the guiding member 27 toward the two-sided conveyance path 82.

Figure 7:
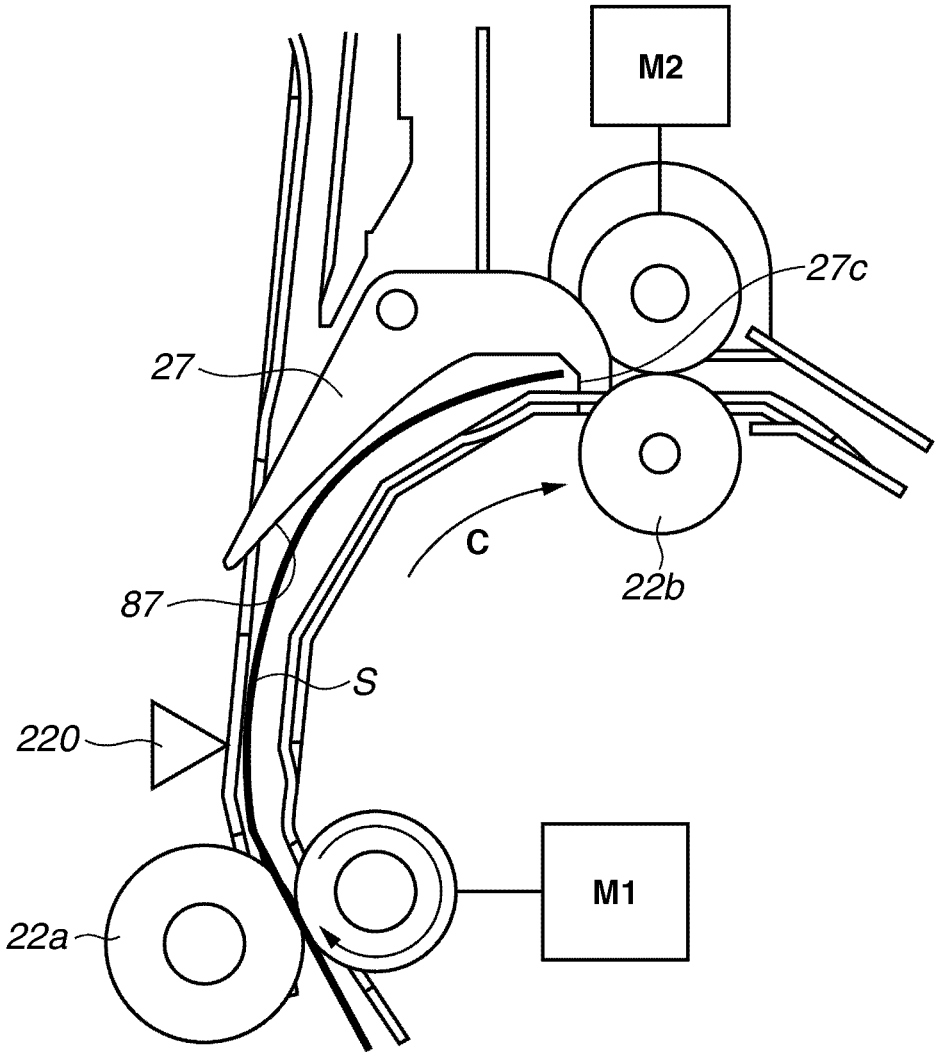
FIG. 7 illustrates a state that a leading edge of the sheet after reversed contacts an abutting portion of the guiding member.

In step S008 of FIG. 3, as illustrated in FIG. 7, the leading edge of the sheet is brought into contact with an abutting portion 27*c* of the guiding member 27. The sheet is aligned when the leading edge of the sheet is brought into contact with the abutting portion 27*c* of the guiding member 27. That is, when the reversing roller pair 22*a* continues to convey the sheet while the leading edge of the sheet contacts the abutting portion 27*c* serving as a skew-feeding correction unit, the leading edge of the sheet forms a loop. When the leading edge of the sheet is brought into contact with the abutting portion 27*c* of the guiding member 27 and the sheet is further forced into the abutting portion 27*c*, the leading edge of the sheet forms a loop and the leading edge of the sheet is aligned with the abutting portion 27*c*, so that the skew-feeding of the leading edge of the sheet is corrected.

Further, if a sheet conveying force is applied to the guiding member 27 by the reversing roller pair 22*a*, the guiding member 27 receives from the conveyed sheet a rotary force in a direction c as illustrated in FIG. 7. When the rotary force becomes more than the biasing force of the torsion coil spring 84, the guiding member 27 starts rotating in the direction c.

Figure 8:
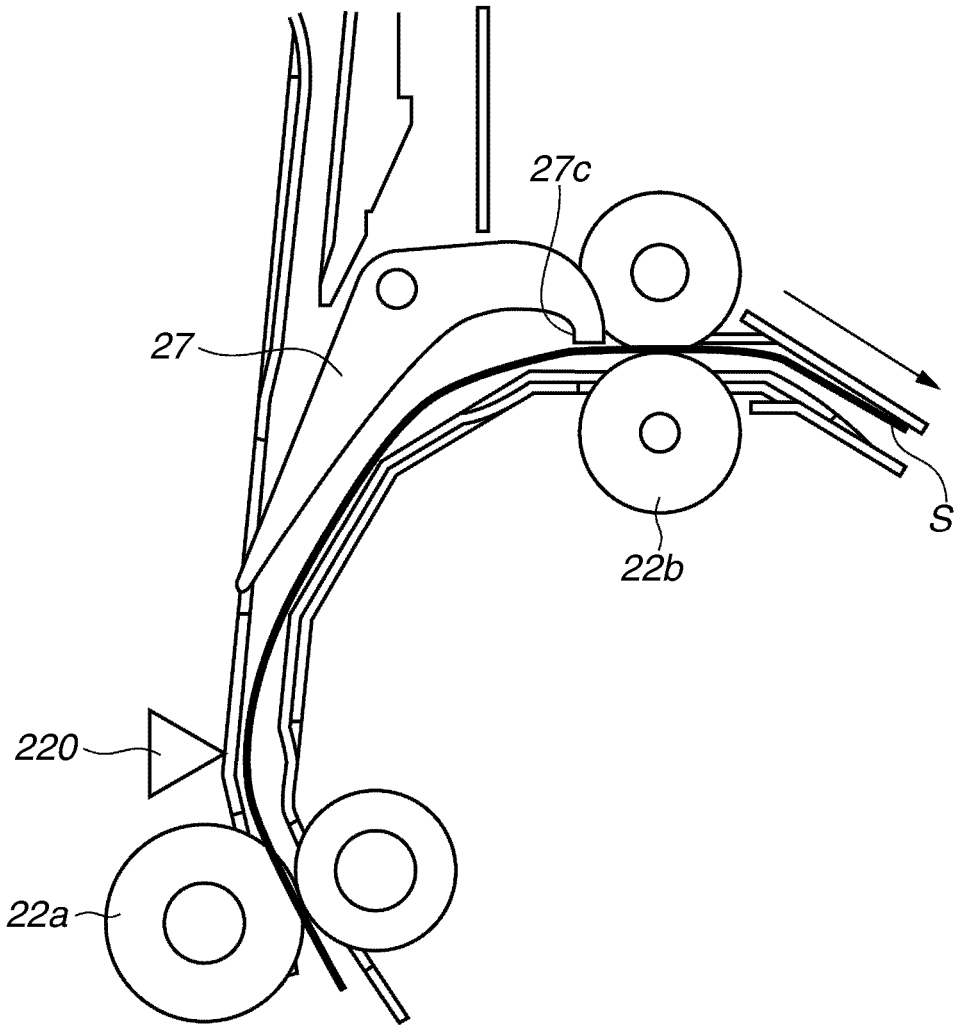
FIG. 8 illustrates a state that the sheet is conveyed after reversed and skew-feeding of the sheet is corrected.

As illustrated in FIG. 8, when the guiding member 27 is pushed and rotated by the leading edge of the sheet, the leading edge of the sheet is immediately nipped by the conveyance roller pair 22*b* which is arranged in the downstream side in the conveying direction. Accordingly, the sheet is conveyed by the conveyance roller pair 22*b*. When the sheet is nipped by the conveyance roller pair 22*b*, the leading edge of the sheet is once aligned by the abutting portion 27*c* of the guiding member 27, and immediately thereafter, is nipped by the conveyance roller pair 22*b*, so that the sheet is conveyed in a corrected state after the skew-feeding of the leading edge of the sheet is corrected by the abutting portion 27*c*. It may also be configured such that the leading edge of the sheet is nipped by the conveyance roller pair 22*b* while the guiding member 27 is swung because the leading edge of the sheet contacts and pushes the abutting portion 27*c*.

When the trailing edge of the sheet passes through the guiding member 27, the biasing force of the torsion coil spring 84 causes the guiding member 27 to recover to the original standby position (see FIG. 2).

When the above described series of reversing operations of the sheet are performed, as is apparent from FIGS. 2 and 6, only the reversing roller pair 22*a* holds and conveys the sheet. As described above, when the sheet is conveyed only by a pair of rollers, the skew-feeding or the oblique-sending tends to readily occur. This skew-feeding is mainly caused because, when a rotary force (bending force) is applied to the sheet, the sheet is short of the strength to keep the orientation of the sheet.

Further, when the sheet is subjected to the reversing operation, i.e., the sheet is subjected to a series of operations such as a conveyance, pausing, a reverse conveyance of the sheet, the sheet may also be bent. This is caused mainly because of the operations of pausing and reverse conveyance of the sheet.

In either case, the above described problems arise due to a difference of conveyance resistance in a front back direction (in a width direction intersecting with the conveying direction of the sheet), a difference in distance between guides, a support configuration of the rollers and backlashes of a bearing and a shaft of the rollers, which generate the force to rotate the sheet.

As described above, in the reversing operation in which the sheet is conveyed only by the reversing roller pair, there are many factors that cause the skew-feeding or the oblique sending of the sheet. In the present exemplary embodiment, the skew-feeding of the sheet can be corrected and the sheet can be conveyed, immediately after the rotation of the reversing roller pair 22*a* is reversed and while the sheet is conveyed by the reversing roller pair 22*a*. Consequently, a position of the sheet is corrected before the skew-feeding or the oblique sending of the sheet caused by the reversing operation of the reversing roller pair 22*a*, becomes larger. The sheet is nipped by the conveyance roller pair 22*b* in a corrected state after correction is carried out.

When the conveyance of the sheet is performed after the rotation of the reversing roller pair is reversed, if the skew-feeding or the oblique sending of the sheet is corrected after a degree of the skew-feeding or the oblique sending becomes larger, for example, the skew-feeding is corrected immediately before sheet is subjected to the processing of the image forming unit, a position of the sheet in the width direction may be often misregistered from a desired position even if the skew-feeding is corrected. In comparison with such a configuration, since the skew-feeding is corrected immediately after the rotation of the reversing roller pair 22*a* is reversed in the present exemplary embodiment, a highly accurate position of the sheet in the width direction can be obtained. As a result, it becomes possible to minimize a misregistration amount of a position of the image when the image is formed on the second surface.

When the sheet passes through the lateral registration detection sensor 24, if the sheet is skew-fed, deterioration of accuracy in detecting the main scanning direction (width direction) of the sheet by the lateral registration detection sensor 24 may occur. Accordingly, the position of the image in the main scanning direction is largely misregistered, and thus a positional error may become larger relative to the image on the front surface. In some cases, the image lies outside the sheet, resulting in remarkably contaminating an image transfer unit, i.e., an adverse effect may secondarily appear.

In the present exemplary embodiment, the skew-feeding of the sheet is corrected immediately after the rotation of the reversing roller pair 22*a* is reversed to start conveying the sheet and before the lateral registration detection sensor 24 detects a position of the sheet in the width direction.

Since the position of the sheet in the width direction is detected by the lateral registration detection sensor 24 after the skew-feeding of the sheet is corrected, the lateral registration detection sensor 24 can provide high detection accuracy. The correction of the skew-feeding is performed after the reversing roller pair 22*a* reverses and conveys the sheet. Consequently, detection is performed by the lateral registration detection sensor 24 after the skew-feeding of the sheet, which might have occurred in the reversing conveyance of the sheet, is corrected. Thus, a highly accurate detection of the position of the sheet can be performed by the lateral registration detection sensor 24 without an adverse effect of the skew-feeding of the sheet which might have occurred in the reversing conveyance of the sheet. Therefore, high accuracy can be obtained with respect to the position of the image which is formed on the second surface of the sheet.

Since the abutting portion 27*c*, which aligns the sheet, is formed at the end portion of the sheet guiding member 27, the sheet reversing operation and the sheet alignment operation can be concurrently performed with fewer parts, a low cost and a simple configuration.

The effects of the present exemplary embodiment are summarized below.

The abutting portion 27*c* of the guiding member 27 is provided in the downstream side in the conveying direction and adjacent to the reversing point after the reversing conveyance of the sheet is performed. Therefore, the skew-feeding or the oblique sending, which occurs when the sheet is reversed, can be effectively corrected in the vicinity of the position where the skew-feeding or the oblique sending occurs.

Further, since the abutting portion 27*c* is provided on the guiding member 27, the number of parts and a manufacturing cost can be reduced. A low cost device can be provided since the skew-feeding of the sheet can be corrected and the sheet can be guided to the two-sided conveyance path 82 without requiring special control.

A second exemplary embodiment is described below.

In the above described first exemplary embodiment, the guiding member 27 is biased in one direction by the torsion coil spring and receives a force from the sheet, thereby being rotated. In the first exemplary embodiment, in a case of a soft thin sheet, it may happen that the alignment operation of the sheet and the rotation operation of the guiding member fail to function under the desired conditions. To the contrary, in a case of a firm thick sheet, inconvenience may occur in conveyance, i.e., the skew-feeding cannot be corrected or the sheet is bent before the guiding member rotates. Therefore, in the first exemplary embodiment, elasticity (thickness) of the sheet to be conveyed is limited, and thus the highly accurate skew-feeding correction and the stable sheet conveyance without any defect can be achieved together only with the sheet of a specific thickness.

In order to convey the sheet of various thickness and elasticity, it is preferable that the rotation of the guiding member is performed by the driving unit. In the second exemplary embodiment, the swingable guiding member 27 is coupled to the solenoid 222 as the driving unit as illustrated in FIG. 10.

The guiding member 27 is rotated driven by the solenoid 222. When no power is sent to the solenoid 222 (when the solenoid 222 is OFF), the guiding member 27 is positioned at a position illustrated in FIG. 10A. When the solenoid 222 is turned ON (hereinafter referred to as the solenoid 222 is ON), the guiding member 27 is moved by the solenoid 222 in a counterclockwise direction from the position of FIG. 10A and rotated to a position illustrated in FIG. 10B. When the solenoid 222 is turned OFF in the state illustrated in FIG. 10B, the guiding member 27 is rotated in the clockwise direction due to its own weight and recovers to the position illustrated in FIG. 10A.

Figure 12:
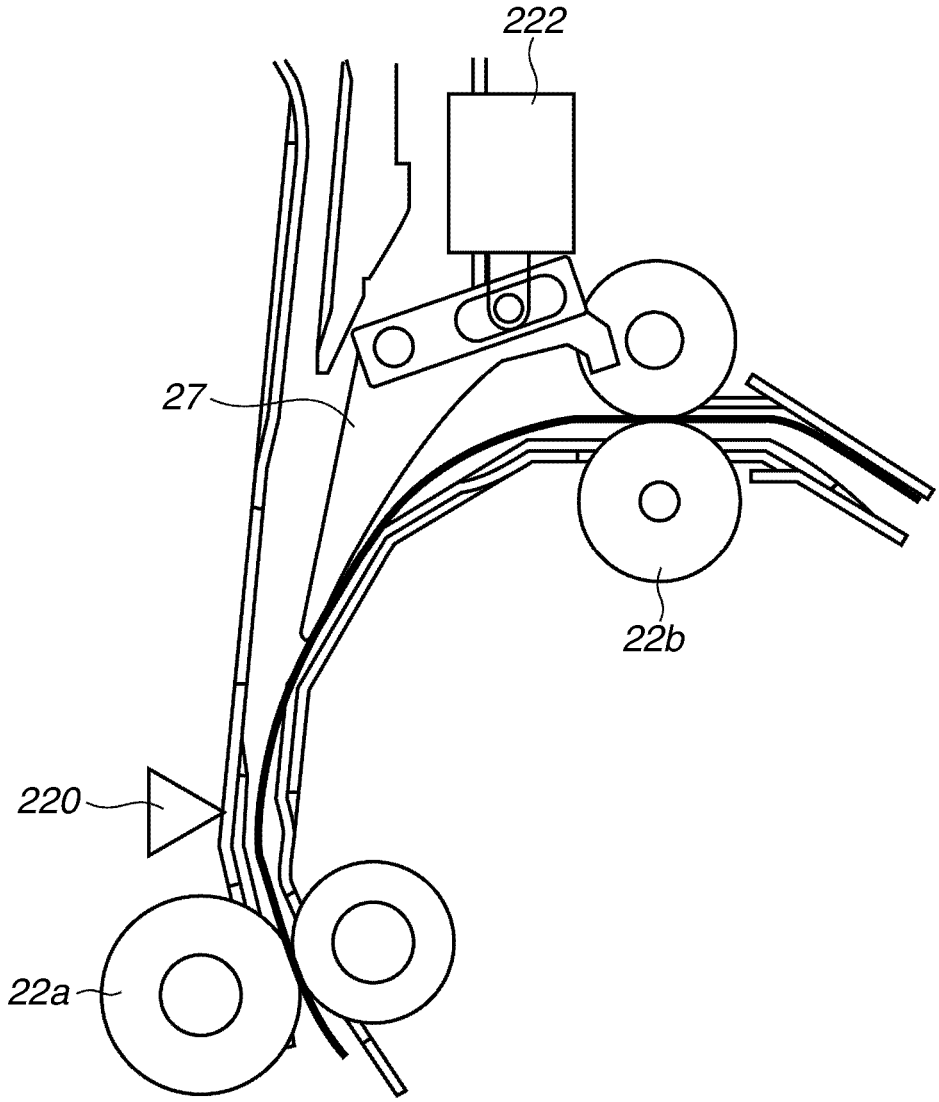
FIG. 12 illustrates another state that the sheet is reversed according to the second exemplary embodiment.
Figure 13:
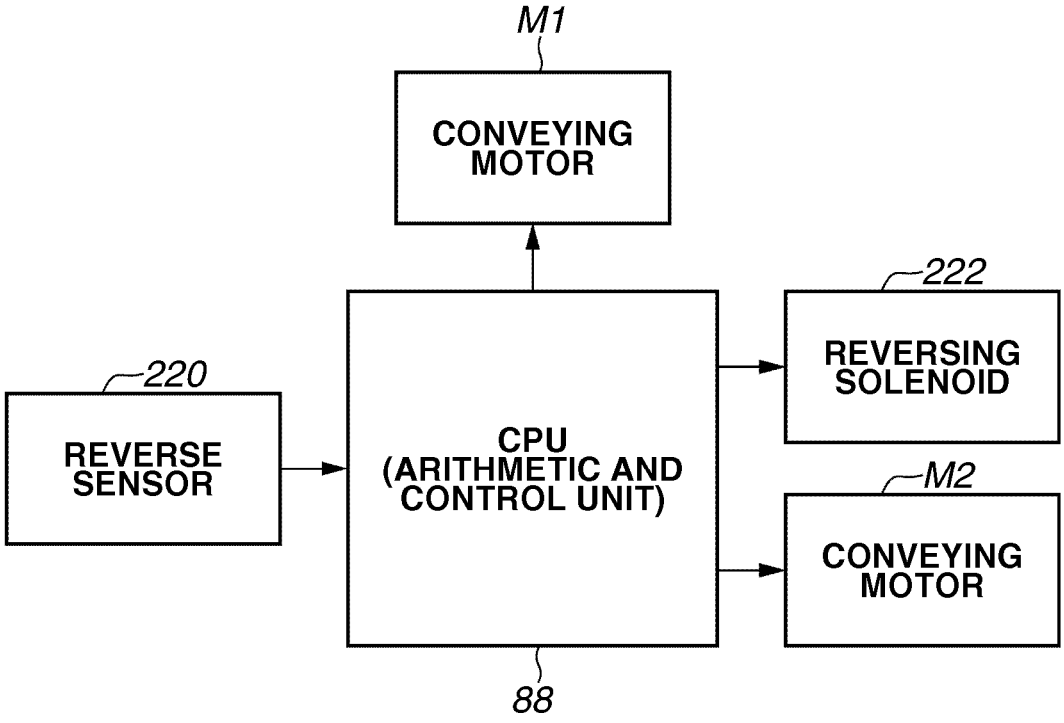
FIG. 13 is a control block diagram according to the second exemplary embodiment.

FIG. 13 is a block diagram illustrating a control system of the present exemplary embodiment. As illustrated in FIG. 12, a signal from the reverse sensor 220 is received by the CPU 88 as the control unit. The CPU 88 controls operations of the reversing motor M1, the conveying motor M2 and the solenoid 222. The CPU 88 is also a control unit which controls operations of the image forming unit 202, the paper feed unit 203, the sheet conveying apparatus 204 and the reader unit R.

Description is made below as to the sheet reversing operation. A series of reversing operations is almost the same as those of the above described first exemplary embodiment, except that the guiding member 27 is moved by using the solenoid 222.

The sheet with an image on the first surface is conveyed from the upstream side through the conveyance path 81. At the time, the solenoid 222 is ON (see FIG. 10A). Then, the sheet is received by the reversing roller pair 22*a* and further conveyed downward, i.e., in the first direction, by the reversing roller pair 22*a*. As the sheet is conveyed downward by the reversing roller pair 22*a*, the trailing edge of the sheet passes through the reverse sensor 220. The CPU 88 reverses the rotation of the reversing roller pair 22*a* as well as turns OFF the solenoid 222 when the reverse sensor 220 detects that the trailing edge of the sheet passes through the reverse sensor 220.

Because the rotation of the reversing roller pair 22*a* is reversed, the sheet is conveyed upward, i.e., in the second direction which is opposite to the direction in which the sheet is presently conveyed, by the reversing roller pair 22*a*. The guiding member 27 moves to the position illustrated in FIG. 10A when the solenoid is turned OFF.

The sheet, which is conveyed upward by the reversing roller pair 22*a*, is guided toward the conveyance roller pair 22*b* by the guiding member 27 which is moved in the clockwise direction when the solenoid 222 is turned OFF.

Figure 11:
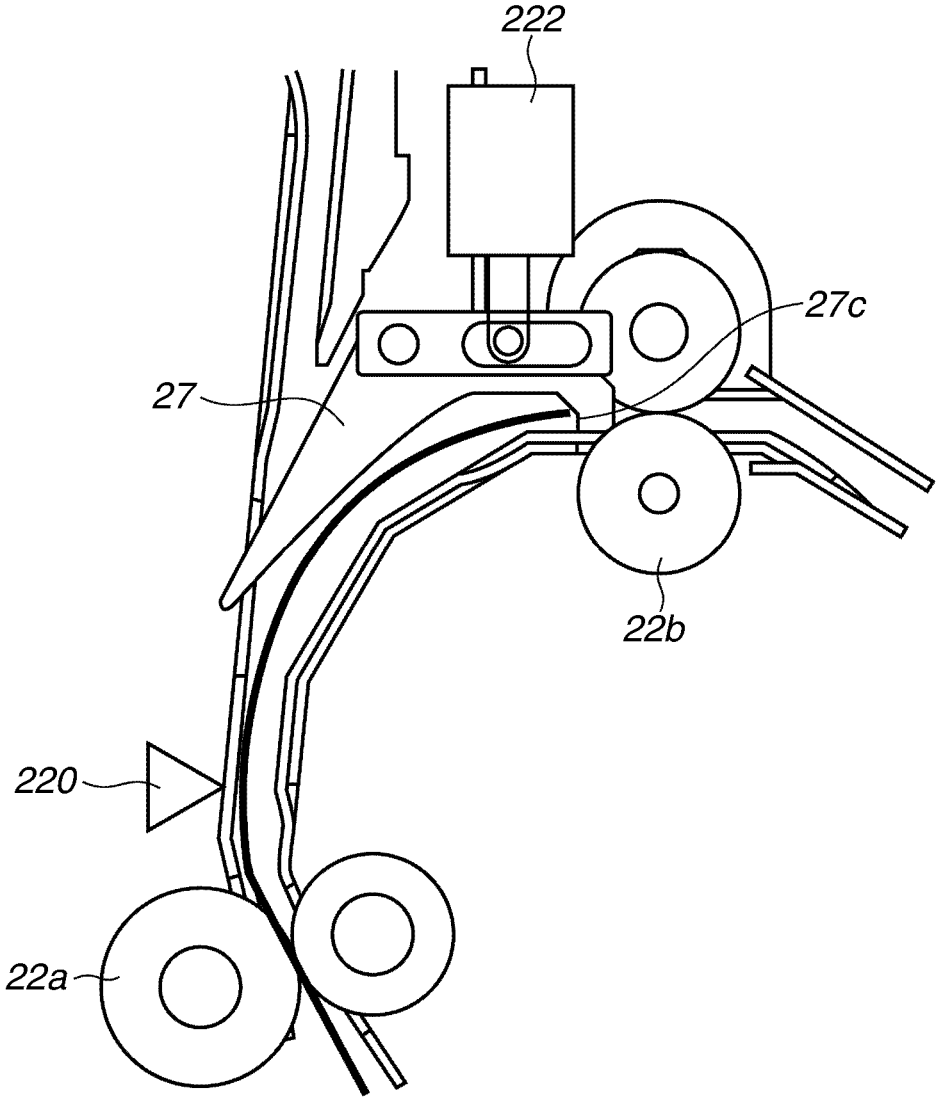
FIG. 11 illustrates a state that the sheet is reversed according to the second exemplary embodiment.

Then, as illustrated in FIG. 11, the leading edge of the sheet comes to contact with the abutting portion 27*c* of the guiding member 27. The leading edge of the sheet contacts the abutting portion 27*c* of the guiding member 27 which aligns the sheet. In other words, the skew-feeding of the leading edge of the sheet is corrected when the leading edge of the sheet contacts the abutting portion 27*c* of the guiding member 27.

The solenoid 222 is turned ON at the time that the skew-feeding of the leading edge of the sheet is appropriately corrected and the guiding member 27 is rotated in the counterclockwise direction. As illustrated in FIG. 12, the leading edge of the sheet is nipped by the conveyance roller pair 22*b*, which is disposed in the immediate downstream side of the abutting portion 27*c* of the guiding member 27 in the conveying direction and the sheet is conveyed by the conveyance roller pair 22*b*. At the time, the leading edge of the sheet is nipped by the conveyance roller pair 22*b* immediately after the leading edge of the sheet is once aligned by the abutting portion 27*c* of the guiding member 27, so that the skew-feeding of the leading edge of the sheet is corrected by the abutting portion 27*c* and the sheet is conveyed in the corrected state. The guiding member 27 is pushed by the leading edge of the sheet while the leading edge of the sheet contacts the abutting portion 27*c*, thereby causing the guiding member 27 to swing. The leading edge of the sheet may be nipped by the conveyance roller pair 22*b* in a rotating state while the guiding member 27 is swinging.

Figure 9:
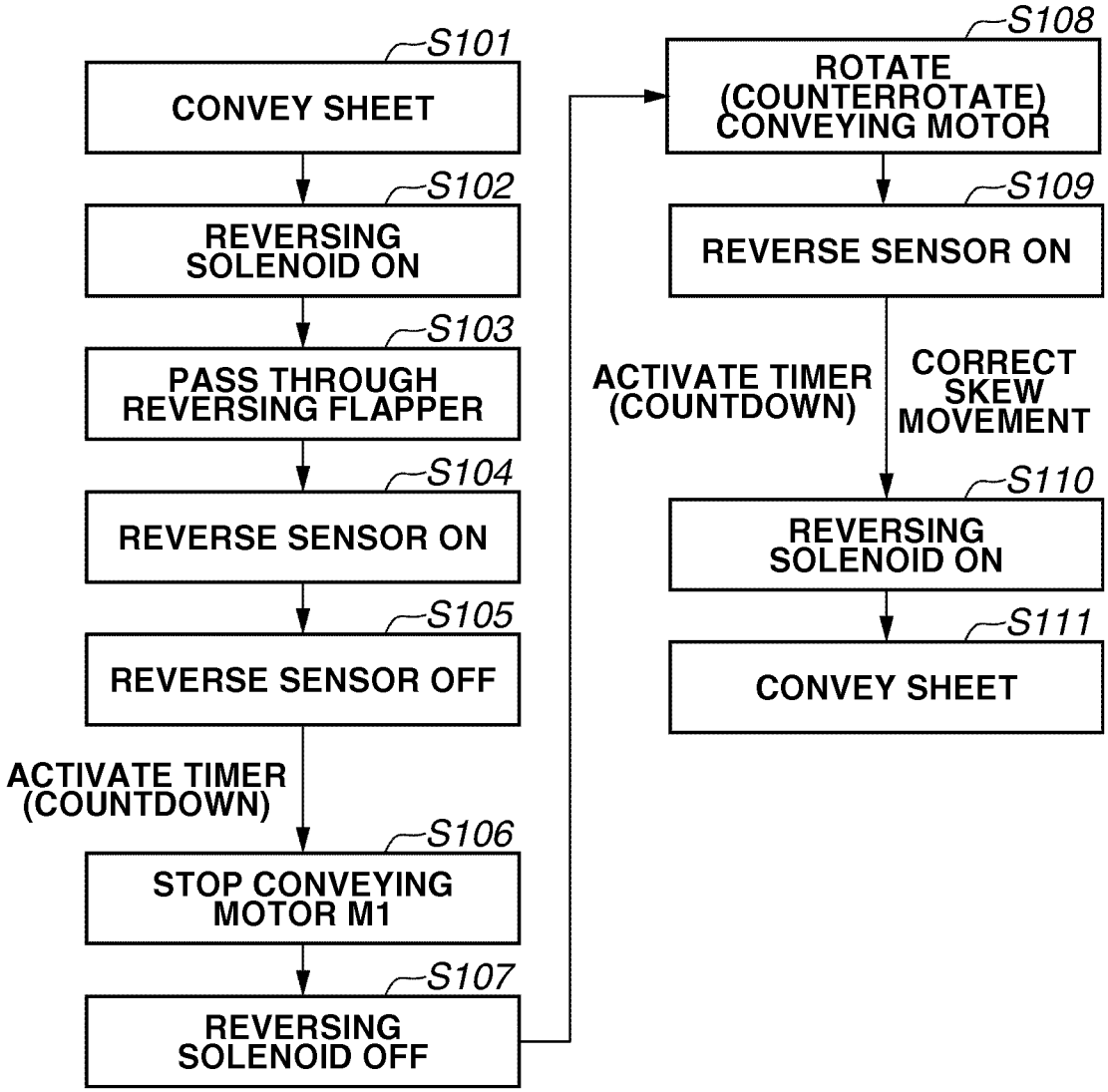
FIG. 9 is a flow chart when control of rotation of the guiding member is performed by using a solenoid.

An operation for controlling the reverse conveyance of the sheet is described below with reference to a flow chart of FIG. 9.

Figure 10A:
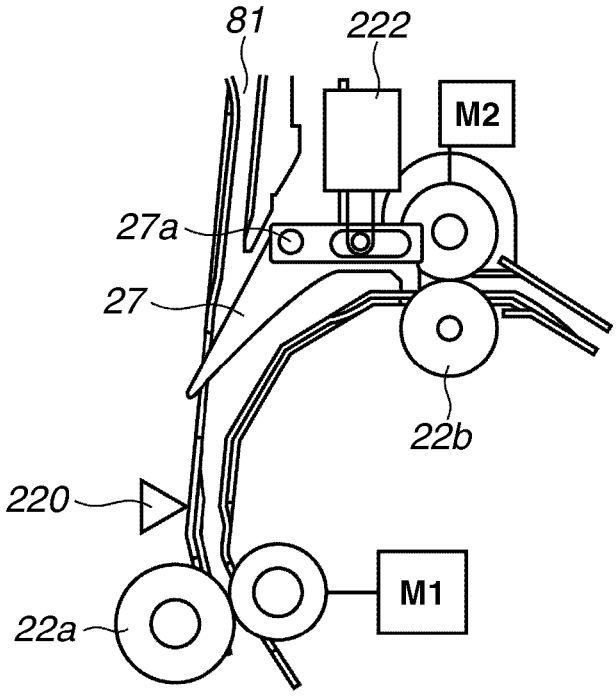
FIGS. 10A and 10B, respectively, is a cross sectional view of a sheet reversing unit according to a second exemplary embodiment of the present invention.
Figure 10B:
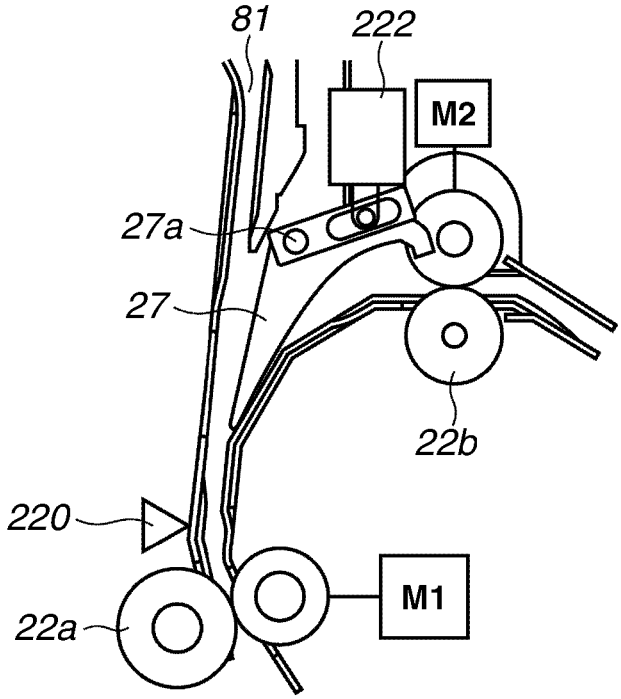

In steps S101 and S102, when the sheet is conveyed through the conveyance path 81, the CPU 88 turns ON the solenoid 222 to place the guiding member 27 at the position illustrated in FIG. 10A. In step S103, when the guiding member 27 is in the above state, the sheet passes through the guiding member 27.

In step S104, when the leading edge of the sheet reaches the reverse sensor 220, the reverse sensor 220 generates an ON signal. Subsequently, the sheet is conveyed to the reversing roller pair 22*a*.

In step S05, when the sheet is conveyed downward by the reversing roller pair 22*a* and the trailing edge of the sheet passes through the reverse sensor 220, the reverse sensor 220 generates an OFF signal. The CPU 88, after receiving the OFF signal from the reverse sensor 220, determines that the trailing edge of the sheet has passed through the guiding member 27. In steps S106, S107 and S108, the CPU 88 performs control to reverse rotation of the reversing motor M1 after once stopping the reversing motor M1 and turns the solenoid 222 ON, after a predetermined time period elapses after the reverse sensor 220 generates the OFF signal.

When the sheet is conveyed upward, an end portion, which is trailing edge until that moment, turns to the leading edge of the sheet and the sheet is conveyed. In step S220, when the leading edge of the sheet passes through the detection point of the reverse sensor 220, the reverse sensor 220 generates the ON signal. The CPU 88 turns the solenoid 222 ON after a predetermined time period, which is a time required for the correction of the skew-feeding, passes from the time the CPU receives the ON signal. In step S111, the leading edge of the sheet is released from retention by the abutting portion 27*c* of the guiding member 27 when the CPU turns the solenoid 222 ON, and the sheet is nipped and conveyed by the conveyance roller pair 22*b*.

In the present exemplary embodiment, the reversing point can be provided at a position adjacent to the abutting portion 27*c* of the guiding member 27. Further, the reverse sensor 220 is provided in order to detect a position of the leading edge of the sheet after the sheet is reversed. Accordingly, a conveying amount of the sheet, after the leading edge of the sheet contacts the abutting portion 27*c*, can be accurately set (controlled). If a conveying amount of the sheet after the leading edge of the sheet contacts the abutting portion 27*c* is too much, the sheet may be damaged. To the contrary, if the conveying amount of the sheet after the leading edge of the sheet contacts the abutting portion 27*c* is too little, the skew-feeding of the sheet cannot be satisfactorily corrected. Therefore, it is material to accurately control the conveying amount of the sheet after the leading edge of the sheet contacts the abutting portion 27*c* for the purpose of accurately correcting the skew-feeding of the sheet while minimizing the damage to the sheet.

The present exemplary embodiment can be applicable to sheets of various thickness (grammage) only by adding the solenoid 222. In other words, an accurate correction of the skew-feeding can be performed regardless of the thickness of sheet.

In the present exemplary embodiment, since the sheet abutting portion is formed on the guiding member 27 similar to the first exemplary embodiment, a device including fewer parts and having a simpler configuration, i.e., a low cost device, can be provided. Since correction of the skew-feeding of the sheet is performed while the sheet is conveyed by the reversing roller pair which tends to cause the skew-feeding or the oblique sending, high correction accuracy can be realized in correcting the skew-feeding.

In both of the exemplary embodiments, the abutting portion 27*c* which is formed on the swingable guiding member 27 is illustrated as an example of the skew-feeding correction unit. However, the skew-feeding of the sheet may be corrected after the rotation of the reversing roller pair 22*a* is reversed and conveyance of the sheet is started and before the position of the sheet is detected by the lateral registration detection sensor 24. For example, the leading edge of the sheet, which is sent out by the reversing roller pair 22*a*, may be received by the conveyance roller pair 22*b* while the conveyance roller pair 22*b* is in rest position, thereby correcting the skew-feeding.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2008-321640 filed Dec. 17, 2008, which is hereby incorporated by reference herein in its entirety.

What is claimed is:

1. An image forming apparatus comprising:

a sheet feeder configured to feed a sheet contained in a sheet container;

an image forming unit configured to form an image on the sheet fed by the sheet feeder;

a conveying path through which the sheet having an image formed by the image forming is conveyed;

a reversing unit configured to reverse the sheet conveyed through the conveying path;

a reconveyance path which diverges from the conveying path at a diverging point and guides the sheet reversed by the reversing unit toward the image forming unit again;

a guiding member which is provided on the diverging portion and swings between a position at which the guiding member allows the sheet conveyed toward the reversing unit to pass through the conveying path and a position at which the guiding member closes the conveying path and guides the sheet conveyed by the reversing unit to the reconveyance path, and an abutting portion which is provided on the guiding member and with which a leading edge of the sheet conveyed by the reversing unit to the reconveyance path contacts for correcting a skew of the sheet.

2. The image forming apparatus according to claim 1, further comprising:

a biasing unit configured to bias the guiding member to the position at which the guiding member guides the sheet conveyed by the reversing unit to the reconveyance path and the leading edge of sheet conveyed by the reversing unit contacts with the abutting portion of the guiding member for correcting skew of the sheet, wherein the sheet, of which leading edge is brought into contact with the abutting portion of the guiding member in order to correct skew of the sheet, causes the guiding member to swing against the biasing force of the biasing unit.

3. The image forming apparatus according to claim 2, wherein the sheet conveyed toward the reversing unit contacts a first side of the guiding member and causes the guiding member to swing against a biasing force of the biasing unit, and wherein the sheet, which is conveyed to the reconveyance path by the reversing unit and of which skew-feeding is corrected by the abutting portion, is guided by a second side of the guiding member to the reconveyance path.

4. The image forming apparatus according to claim 1, further comprising:

a driving unit configured to move the guiding member; and a control unit configured to control an operation of the driving unit;

wherein the control unit controls an operation of the driving unit such that the guiding member moves from a first position where the guiding member guides the sheet conveyed by the reversing unit in the reconveyance path and the leading edge of the sheet conveyed is brought into contact with the abutting portion of the guiding member to a second position where the guiding member allows the leading edge of sheet to pass the guiding member.

5. The image forming apparatus according to claim 1, further comprising a conveyance roller pair disposed in the vicinity of the abutting portion of the guiding member, wherein the sheet, of which skew-feeding is corrected by causing the leading edge of the sheet to contact the abutting portion, is conveyed by the conveyance roller pair.

6. The image forming apparatus according to claim 5, wherein the sheet is nipped by the conveyance roller pair while the sheet contacts the abutting portion and thereby the guiding member is swinging.

7. The image forming apparatus according to claim 1, wherein the image forming unit has an image bearing member bears an image thereon, an intermediate transfer member on which the image on the image bearing member is primary transferred, and a transferring member which secondary transfers the image on the intermediate transfer member to the sheet, wherein the image forming unit corrects the position of the image bored on the image bearing member based on the signal from the positioning detection unit.

8. The image forming apparatus according to claim 1, further comprising:

a position detection unit which is provided on the reconveyance path and configured to detect a position of the sheet in a width direction which intersects with a sheet conveying direction of the sheet conveyed, wherein the position detection unit is disposed on the downstream of the guiding member, and wherein the image forming unit corrects a position of the image to be formed on the sheet, which has been conveyed through the reconveyance path, based on a signal from the positioning detection unit.

9. A sheet conveying apparatus comprising:

a conveying path (81) through which a sheet is conveyed;

a reversing conveying unit configured to convey the sheet in a first direction and then convey the sheet in a second direction opposite to the first direction;

a diverging path (82) which diverges from the conveying path at a diverging portion (83) and guides the sheet conveyed by the reversing conveying unit;

an abutting portion which is abutted by a leading edge of the sheet conveyed by the reversing conveying unit in the second direction for correcting a skew of the sheet and is movable to a first attitude of being abutted by the leading edge of the sheet and to a second attitude of allowing passage of the sheet;

a biasing portion which biases the abutting portion to the first attitude; and a guide portion, provided on the diverging portion and integrally formed with the abutting portion, which is biased by a biasing force of the biasing portion to a position where the guiding portion closes the conveying path and guides the sheet conveyed by the reversing conveying unit in the second direction into the diverging path, wherein the guiding portion is moved against the biasing force of the biasing portion by contacting the sheet being conveyed toward the reversing conveying unit to pass the conveying path.

10. A sheet conveying apparatus according to claim 9, wherein the sheet, of which a leading end is brought into contact with the abutting portion, moves the abutting portion against the biasing force of the biasing portion for correcting a skew of the sheet.

11. A sheet conveying apparatus according to claim 9, wherein a conveyance roller pair is disposed in the vicinity of the abutting portion.

12. A sheet conveying apparatus according to claim 10, wherein the sheet is nipped by the conveyance roller pair while the sheet contacts the abutting portion.

13. A sheet conveying apparatus according to claim 10, further comprising:

a position detection unit which is provided on downstream of the butting portion and configured to detect a position of the sheet in a width direction which intersects with a sheet conveying direction, and an image forming unit configured to form an image on the sheet, wherein the image forming unit corrects a position of the image to be formed on the sheet based on a signal from the positioning detection unit.

* * * * *